US005793347A

United States Patent [19]

Mugridge

[11] Patent Number: 5,793,347

[45] Date of Patent: Aug. 11, 1998

[54] GREYSCALE OF FERROELECTRIC LCD VIA PARTIAL PIXEL SWITCHING AND VARIOUS BIPOLAR DATA WAVEFORMS

[75] Inventor: Robin Mugridge, High Wycombe, England

[73] Assignee: Central Research Laboratories Limited, England

[21] Appl. No.: 392,904

[22] PCT Filed: Sep. 20, 1993

[86] PCT No.: PCT/GB93/01973

§ 371 Date: Mar. 1, 1995

§ 102(e) Date: Mar. 1, 1995

[87] PCT Pub. No.: WO94/07235

PCT Pub. Date: Mar. 31, 1994

[30] Foreign Application Priority Data

Sep. 23, 1992 [GB] United Kingdom ..... 9220132

[51] Int. Cl.[6] ..... G09G 3/36

[52] U.S. Cl. ..... 345/94; 345/89

[58] Field of Search ..... 345/94–95, 97, 345/98, 89, 58, 87, 147, 148, 149, 208, 210; 359/56, 900; 349/33, 34, 35, 37, 42

[56] References Cited

U.S. PATENT DOCUMENTS

| | | | |
|---|---|---|---|
| 4,904,064 | 2/1990 | Lagerwall et al. | 359/56 |
| 5,047,757 | 9/1991 | Bone et al. | 345/97 |
| 5,227,900 | 7/1993 | Inaba et al. | 345/97 |
| 5,267,065 | 11/1993 | Taniguchi et al. | 345/97 |
| 5,398,042 | 3/1995 | Hughes | 345/94 |
| 5,424,753 | 6/1995 | Kitagawa et al. | 345/94 |
| 5,515,073 | 5/1996 | Surguy | 345/97 |
| 5,521,727 | 5/1996 | Inaba et al. | 345/97 |

*Primary Examiner*—Dennis-Doom Chow

*Attorney, Agent, or Firm*—Evenson, McKeown, Edwards & Lenahan, P.L.L.C.

[57] ABSTRACT

A method of addressing FLCDs produces one or more gray levels by switching part of the pixel. This is achieved by applying a waveform which changes between a voltage level which switches the entire pixel and a voltage level which does not switch any part of the pixel, such that the data signal requires only two voltage levels.

4 Claims, 6 Drawing Sheets

GREYSCALE OF FERROELECTRIC LCD VIA PARTIAL PIXEL SWITCHING AND VARIOUS BIPOLAR DATA WAVEFORMS

BACKGROUND OF THE INVENTION

This invention relates to the addressing of ferroelectric liquid crystal displays or FLCDs, and in particular to a method of addressing a matrix-type liquid crystal cell to produce grey levels.

DESCRIPTION OF THE RELATED ART

A matrix-type liquid crystal cell comprises a matrix of pixels defined by the intersection of row and column electrodes mounted on opposing substrates. One known method of addressing such a cell includes the features set forth in the preamble of claim 1 and is disclosed in GB-A-2146473.

In the known method, which employs so-called blank before write, signals applied to the column electrodes, or data signals, take two forms, either "on" or "unchanged". Synchronised with these signals are signals which are applied to the row electrodes: "select" or "non-select". Furthermore "blank" signals are periodically applied to the row electrodes. At any one time, only one row electrode has the "select" signal applied to it; all the remaining row electrodes have the "non-select" signal applied to them.

The addressing scheme operates in the following manner. Data signals are applied to the column electrodes in order to create the desired pattern in the row of pixels corresponding to the row electrode to which the select signal is applied. The arrangement is such that this row will previously have been blanked by the application to the corresponding electrode of the blanking signal. This has the effect of setting that row into a particular state, usually the dark (or "off") state.

Addressing methods are also disclosed in EP-A-0337780, EP-A-0370649 and EP-A-0394903.

In such a system, it is a requirement to maintain dc compensation, or charge balancing. This necessitates both the "on" and "unchanged" data signals having no net dc component, and preferably also the sum of the blanking, select and non-select signals having no net dc component.

Known methods of generating grey levels include spatial dither, temporal dither and threshold variation techniques. Spatial dither involves the subdivision of each pixel into separate areas which can be switched individually. This has the disadvantage of increasing the complexity of the display by the electrode patterning and interconnection required. Temporal dither, wherein a pixel is addressed with different data several times per picture to create a perceived grey has the disadvantage of requiring high speed electronics which limits the maximum size of the display. Threshold variation involves the division of each pixel into a plurality of regions having different switching thresholds, such that a particular addressing signal may switch only some of the regions giving a grey effect. This technique is complicated by the fact that its operation requires more than two data voltage levels.

This invention seeks to alleviate these disadvantages.

SUMMARY OF THE INVENTION

According to the present invention there is provided a method of addressing a matrix of pixels which are defined by areas of overlap between members of a first set of electrodes on one side of a layer of ferroelectric material, and members of a second set of electrodes which cross the members of the first set, on the other side of the material, in which method unipolar blanking signals are applied to the members of the first set of electrodes to effect blanking before unipolar select signals are applied thereto one by one to effect addressing of the corresponding pixels by simultaneously applying a selected charge-balanced bipolar data waveform to each member of the second set of electrodes, the data waveforms each comprising pulses of two respective voltage levels, characterized in that the data waveforms are selected from data waveforms of at least first, second and third forms which, when combined with select signals, produce resultant waveforms of a first kind which causes switching of substantially the entire pixel, a second kind which leaves substantially the entire pixel unswitched, and a third kind which causes switching of part of the pixel, respectively, a resultant waveform of the first kind including a pulse having a first voltage level and a given duration, which pulse causes switching of substantially the entire pixel, a resultant waveform of the second kind including a pulse having a second voltage level which is incapable of switching substantially any part of the pixel, and a resultant waveform of the third kind including a plurality of pulses at least one of which is of the first voltage level and at least one of which is of the second voltage level, the duration of the or each pulse of the first voltage level being less than the given duration and the plurality causing switching of part of the pixel.

This method allows one or more grey levels to be produced in a single addressing operation without requiring more than two data voltage levels.

In an arrangement where the pixels are of a uniform material, switching of part of the pixel may be effected by partial switching, whereby certain domains of the material in the pixel are switched whilst others are not. Stable partial switching of a pixel throughout a frame time is achieved since the crosstalk (data waveforms combined with the non-select signal) is charge balanced; that is, each data waveform has equal positive and negative parts, and thus has no overall dc component. In this way, the crosstalk has a stabilising effect on the partially switched pixel so that the grey level is held constant throughout the frame time.

Alternatively, in an arrangement where the pixels each comprise a plurality of regions having different switching thresholds, switching of part of the pixel may be effected by only some of the regions switching.

The number of grey levels achievable with this method depends on the number of possible changes in voltage level for each signal, known as time slots. In a four slot scheme wherein the select pulse lasts for two time slots, one grey level switching waveform can be achieved which will include one pulse of the first voltage level and one pulse of the second voltage level. In a six slot scheme the select pulse covers three time slots, and two grey levels can be achieved; one in which the waveform comprises one pulse of the first voltage level and two pulses of the second voltage level, and another in which there are two pulses of the first level and one of the second level.

BRIEF DESCRIPTION OF THE DRAWINGS

In order that the present invention may be more readily understood, reference will be made, by way of example, to the accompanying diagrammatic drawings, in which.

DETAILED DESCRIPTION OF THE PREFERRED EMBODIMENTS

Figure 1:
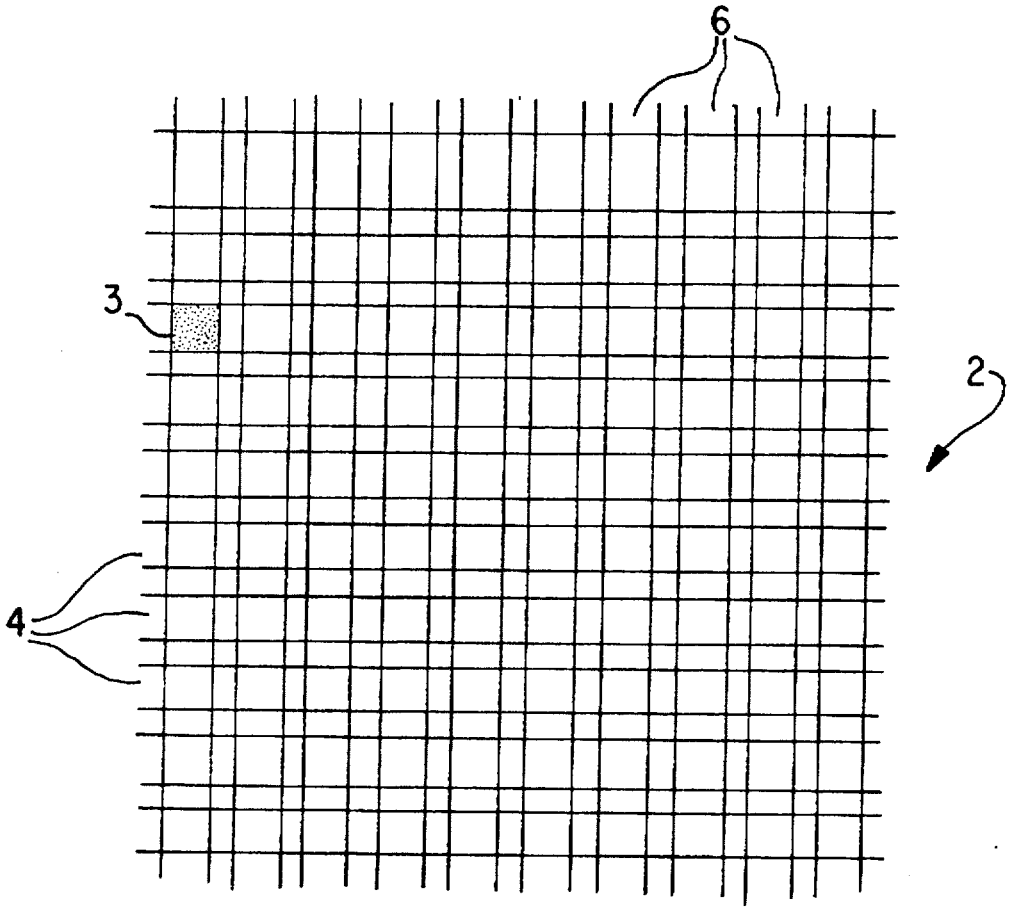
FIG. 1 is a plan view of a matrix-type liquid crystal cell.

Referring to FIG. 1, a matrix-type liquid crystal cell, indicated generally by 2, comprises an array of overlapping orthogonal row 4 and column 6 electrodes between which is disposed liquid crystal material (not shown). Where each row electrode 4 overlaps a column electrode 6, a pixel (for example 3) is defined.

Figure 2:
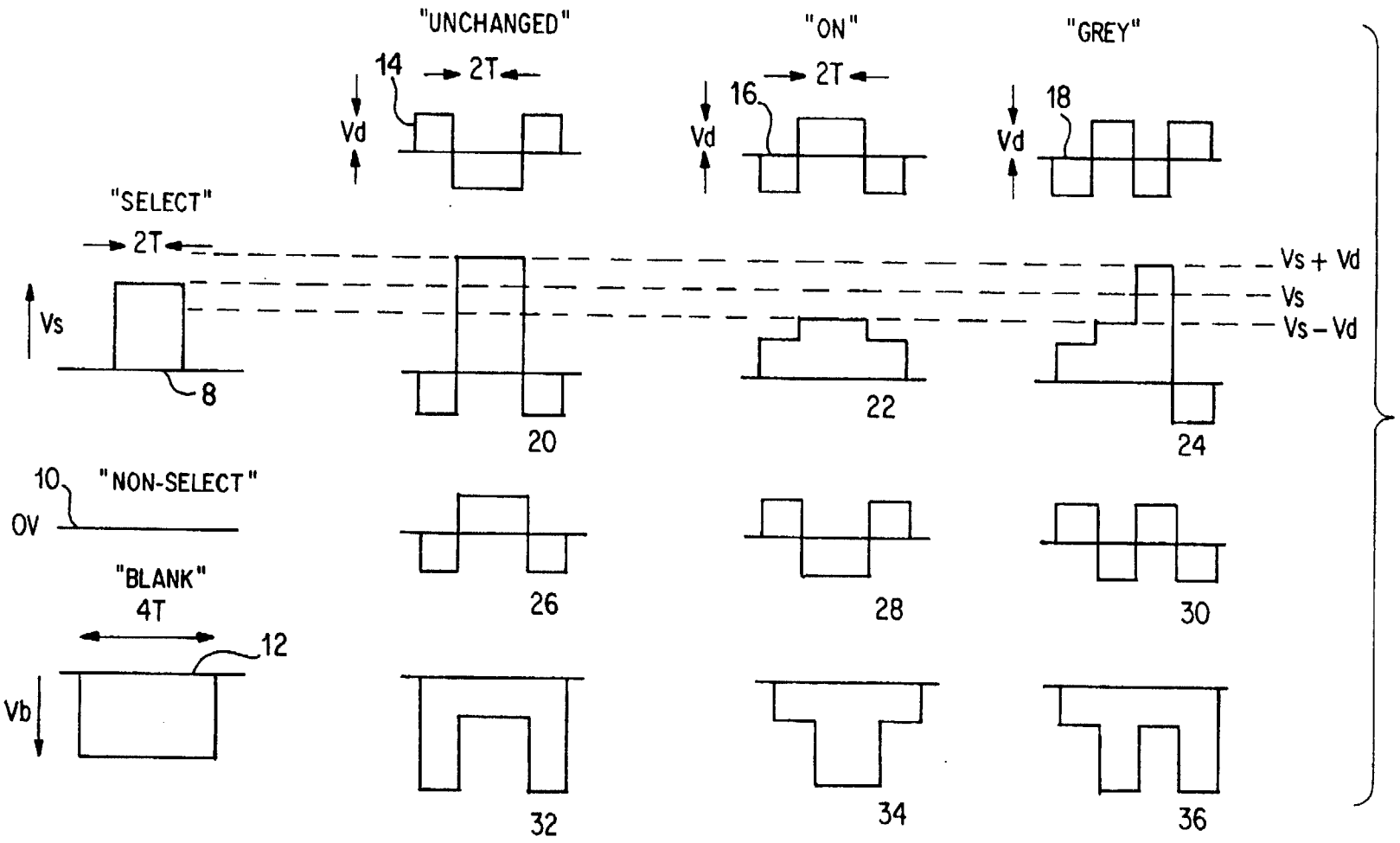
FIG. 2 shows signals which may be applied to the sets of electrodes shown in FIG. 1, and resulting waveforms, in accordance with the invention.

Referring now also to FIG. 2, the signals which may be applied to the row electrodes 4 are the "select" 8, "non-select" 10 and "blank" 12 signals. The data signals which may be selectively applied to the column electrodes 6 synchronously with the row electrode signals 8, 10, 12 are "unchanged" 14, "on" 16 and "grey" 18.

The method of addressing the display is as follows. The display is addressed on a line by line basis; that is one row at a time. Each row must be "blanked" shortly before addressing, so at any given time the blanking signal 12 is being applied to at least one row, the select signal is being applied to another row which has previously been blanked and all the other rows are receiving the non-select signal 10.

Simultaneously, one of the data signals 14, 16, 18 is being applied to each column electrode 6 depending on the required state of each pixel in the row being addressed. For the rows where the non-select signal 10 is being applied, the data signal 14, 16 or 18 each pulse of which has a magnitude $V_d$, combines with the non-select signal to give a waveform 26, 28, or 30, so that the state of the pixel is not changed. For the row receiving the blank signal 12 of magnitude $V_b$, the data signals 14, 16 or 18 will in each case combine with $V_b$ to give waveforms 32, 34 or 36 which all switch the pixels to the dark state. For the row being addressed, one of the data signals 14, 16 or 18 is chosen to combine with the select signal of magnitude $V_s$ either to switch the relevant pixel on (22), leave it unchanged (20), or switch it to a grey state (24).

Figure 4:
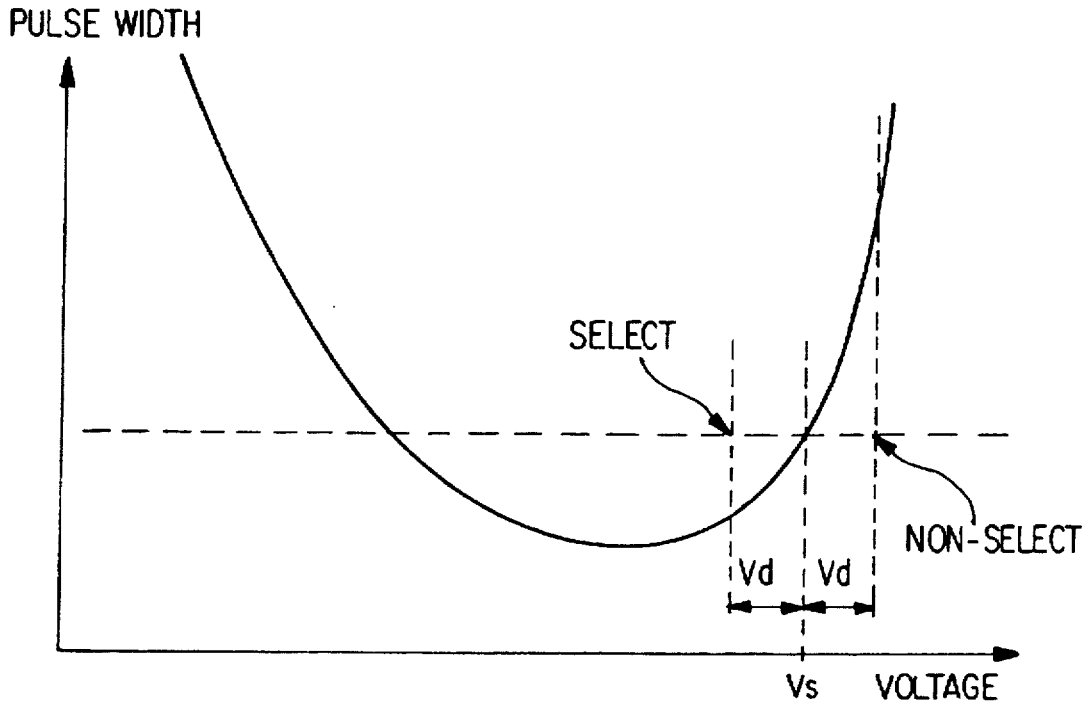
FIG. 4 is a graph of applied pulse width against voltage for each pixel.

A ferroelectric liquid crystal material may have the switching characteristic shown in FIG. 4. In this example, the inverse mode of operation is used. In such mode, $V_s$ lies on the upward part of the switching threshold curve, and the pixel is switched by a lower voltage, $V_s-V_d$, but not switched by a higher voltage $V_s+V_d$.

Figure 5:
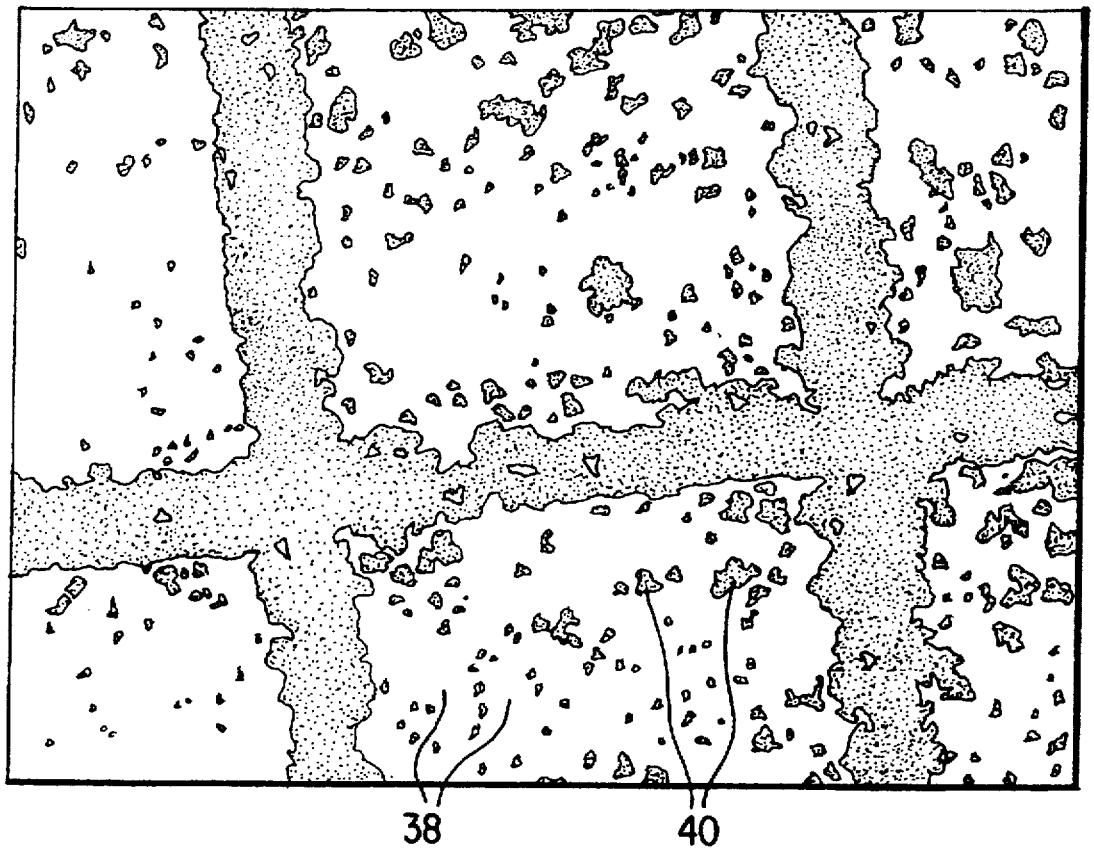
FIG. 5 shows part of a liquid crystal cell with the pixels in a partially switched state.

To achieve a grey state of the pixel, the applied voltage changes between $V_s+V_d$ and $V_s-V_d$, as shown at 24. This causes part of the pixel to switch, in a manner known as partial switching. Referring to FIG. 5, a partially switched pixel includes switched domains 38 and other domains 40 which are not switched, giving the impression of a grey level.

The pixel remains in this state throughout the frame time since the crosstalk, caused by data signals 26, 28, 30 seen by the pixel in a non-select condition, are charge balanced and act as a form of stabilisation.

Figure 6:
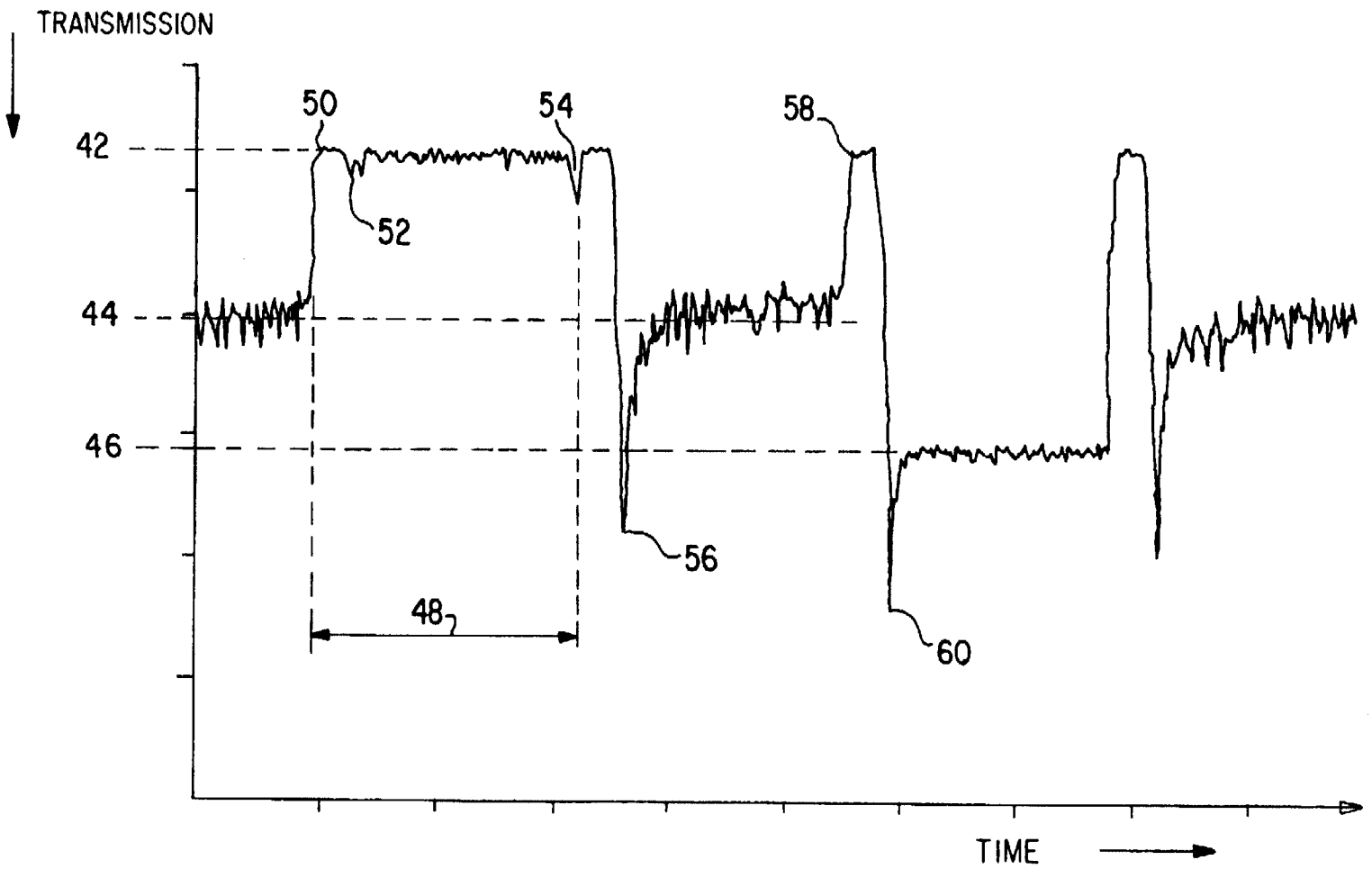
FIG. 6 is an oscilloscope trace of light transmission against time for a pixel being addressed by a method according to the present invention.

Referring to FIG. 6, addressing of the pixel to cause each of the three levels of light transmission 42, 44, 46 can be seen. At the start of one frame time, (indicated by 48) the blanking waveform 32, 34 or 36 is applied at 50 causing the pixel to be switched to its dark state 42. Addressing of the pixel by waveform 20 is shown at 52, which causes the state of the pixel to remain unchanged, or dark 42.

For the next frame, the blanking pulse is applied at 54, and the grey addressing waveform 24 is applied at 56. It can be seen that the pixel stabilises in a grey state 44 until the next blanking pulse is applied at 58, although this grey state can be seen to be slightly less uniform in level of light transmission than either the previous dark state 42, or the light state 46 which is initiated by waveform 22 shown at 60.

Figure 3:
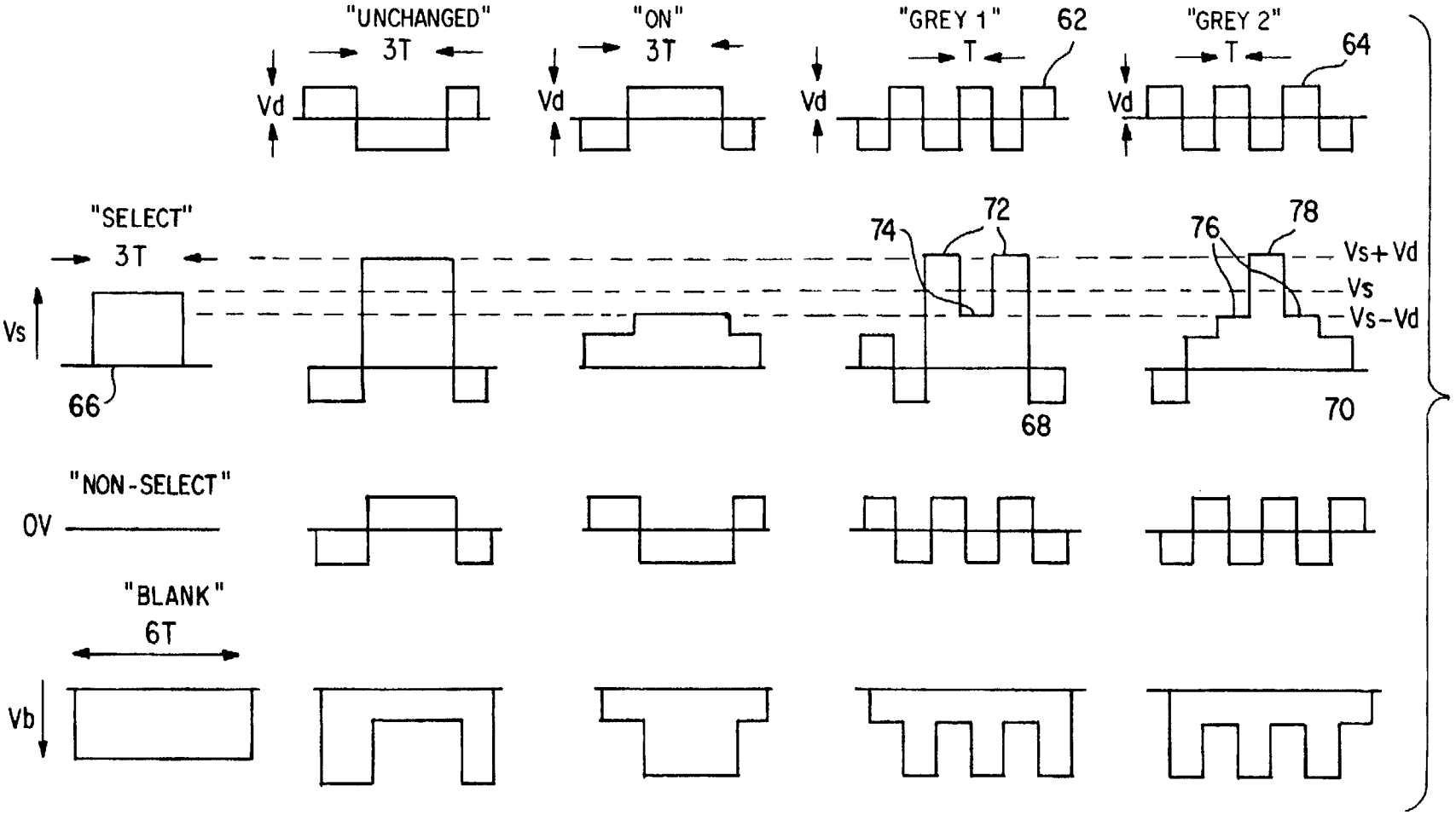
FIG. 3 shows alternative signals and waveforms to those of FIG. 2.

The example of FIG. 2 is known as a four-slot addressing scheme, since each resulting waveform consists of 4 time slots. If the number of time slots is increased to six, as shown in FIG. 3, two different grey levels can be achieved.

The two data signals for producing grey are shown at 62 and 64. These combine with the select signal 66 to give two addressing waveforms 68, 70. The first waveform 68 contains two pulses 72 at the non-switching voltage $V_s+V_d$ and one pulse 74 at the switching voltage $V_s-V_d$. The other waveform 70 contains two pulses 76 of voltage level $V_s-V_d$, and one of level $V_s+V_d$, to give a lighter grey level, since more of the pixel will be switched.

Whilst various embodiments of the invention have been described, it will be appreciated that modifications may be made without departing from the scope of the invention. For example, more time slots may be used to give a greater number of possible grey levels.

The addressing scheme may also be used with pixels which each have a plurality of regions with different switching characteristics.

For example, in a four slot scheme, the pixel may comprise two regions having different switching thresholds. The pulse of voltage level $V_s-V_d$ contained in the 'on' waveform 22, will lie within the switching characteristic curve for both of the regions of the pixel to switch both to a light state, whilst the pulse $V_s+V_d$ of the 'unchanged' waveform 20 will lie outside the curve for both regions, and leaving both in a dark state. The grey waveform 24 will switch one region to the light state whilst the other will remain dark. In a six slot scheme, the pixel may have three regions, and thus be capable of producing two grey levels, and so on.

I claim:

1. A method of addressing a matrix of pixels which are defined by areas of overlap between members of a first set of electrodes on one side of a layer of ferroelectric material, and members of a second set of electrodes which cross the members of the first set, on the other side of the material, in which method unipolar blanking signals are applied sequentially to the members of the first set of electrodes to effect blanking before unipolar select signals of a given duration are applied sequentially to the members of said first set of electrodes to effect addressing of the corresponding pixels by simultaneously applying a selected charge-balanced bipolar data waveform to each member of the second set of electrodes, the data waveforms each comprising pulses of two respective voltage levels wherein:

the data waveforms are selected from data waveforms of at least first, second and third forms which, when combined with select signals, produce resultant waveforms of a first kind which causes switching of substantially the entire pixel, a second kind which leaves substantially the entire pixel unswitched, and a third kind which causes switching of part of the pixel, respectively;

a resultant waveform of the first kind includes a pulse having a first voltage level for said given duration, which pulse causes switching of substantially the entire pixel;

a resultant waveform of the second kind includes a pulse maintaining for said given duration a second voltage level which is incapable of switching substantially any part of the pixel; and a resultant waveform of the third kind includes within said given duration at least one transition between the first voltage level and the second voltage level, said waveform of the third kind causing switching of part of the pixel.

2. A method as claimed in claim 1, wherein the ferroelectric material is liquid crystal material.

3. A method as claimed in claim 2, wherein the members of the second set of electrodes are oriented orthogonal to the members of the first set of electrodes.

4. A method as claimed in claim 1, wherein the members of the second set of electrodes are oriented orthogonal to the members of the first set of electrodes.

* * * * *